US006606929B2

(12) United States Patent
Evreniadis

(10) Patent No.: US 6,606,929 B2
(45) Date of Patent: Aug. 19, 2003

(54) APPARATUS AND METHOD FOR CUTTING GEL AND OTHER SHEET MATERIALS

(76) Inventor: Joseph H. Evreniadis, 1751 W. Henderson St., Chicago, IL (US) 60657

( * ) Notice: Subject to any disclaimer, the term of this patent is extended or adjusted under 35 U.S.C. 154(b) by 0 days.

(21) Appl. No.: 09/891,013

(22) Filed: Jun. 25, 2001

(65) Prior Publication Data

US 2002/0194970 A1 Dec. 26, 2002

(51) Int. Cl.[7] ..... B26D 7/06; B26D 7/02

(52) U.S. Cl. ..... 83/408; 83/56; 83/34; 83/167; 83/455

(58) Field of Search ..... 83/34, 156, 167, 83/84, 86, 90, 155, 76.9, 152, 56, 408, 451, 455, 452

(56) References Cited

U.S. PATENT DOCUMENTS

| | | | | |
|---|---|---|---|---|
| 2,035,946 A | | 3/1936 | Cummings | |
| 2,747,664 A | | 5/1956 | Corson | |
| 3,296,911 A | | 1/1967 | McLane | |
| 3,861,325 A | * | 1/1975 | Bue et al. | 108/13 |
| 3,967,519 A | * | 7/1976 | Easterly | 83/455 |
| 4,351,208 A | | 9/1982 | Cobleigh et al. | |
| 4,843,972 A | * | 7/1989 | Kabilka et al. | 104/296 |
| 5,025,692 A | | 6/1991 | Reynolds | |
| 5,028,011 A | * | 7/1991 | Schiffers | 242/527 |
| 5,894,978 A | | 4/1999 | Welch et al. | |

OTHER PUBLICATIONS

Meterman—http://www.meter–man.com/electrnc.html—3 pages, 2001.*

* cited by examiner

*Primary Examiner*—Paul T. Sewell
*Assistant Examiner*—M. Chambers

(57) ABSTRACT

Manually operable apparatus for cutting gel or other sheet material comprises a cutting table and a longitudinally reciprocable traveling bridge mounting a transversely translatable cutter carriage supporting a cutter assembly for manually selective movement to any position on the cutting table. The cutter assembly is employed for making longitudinal as well as transverse cuts of the sheet material. An associated method is also disclosed.

4 Claims, 9 Drawing Sheets

APPARATUS AND METHOD FOR CUTTING GEL AND OTHER SHEET MATERIALS

BACKGROUND OF THE INVENTION

This invention relates to apparatus for manually cutting strips and rectangular sections of material from a continuous or discrete web of paper, plastic, or other sheet material. It is known to have extraordinary utility for cutting gel and will be described in that context.

Gel material used to color and modify lighting on movie and stage sets, for example, is available in a multitude of colors and is shipped on three and four foot rolls. Lighting technicians traditionally cut the gel material from the rolls using a razor and straight edge or other common hand tools. This procedure is laborious, time-consuming, inaccurate and wasteful of the sheet material being cut. Some sheet materials, such as gel, with which the invention may be used are very costly, and waste thereof is desired to be avoided.

OBJECTS OF THE INVENTION

It is an object of the invention to provide apparatus for cutting gel and other sheet materials which is easy and rapid in use, and precise and accurate in operation.

It is another object to provide such apparatus which is highly versatile, being capable of cutting long strips or discrete sections from a continuous web of material, or for cutting smaller sections from a larger section of loose sheet material.

It is yet another object to provide such apparatus which is rugged and reliable.

DESCRIPTION OF THE PREFERRED EXECUTIONS

The invention has numerous applications including application to the task of cutting gel for stage and movie lighting and the like. The figures illustrate a preferred embodiment of the invention which has the following components.

20. cutting table assembly

22. frame May be of hardwood, metal, or other suitable material.

24. cutting table Preferably of half-inch polyvinyl chloride.

26. longitudinal grooves The cutting table is grooved at 1" intervals, for example, to improve the cutting action of the cutter blade. It is important that the grooves not be wider than about one-eighth inch.

28. transverse groove The transverse groove improves the cutting action of the cutting blade when cutting transversely across the table. Again, a groove width no greater than about one-eighth inch is desired. The groove depth may be about one-eighth inch.

30. traveling cutter bridge Supports the cutter assembly 58 and retractable bridge idler roller 32. Preferably employs an aluminum "U" channel for stiffness and to guide the vertical reciprocal movement of the bridge idler roller.

Figure 4:
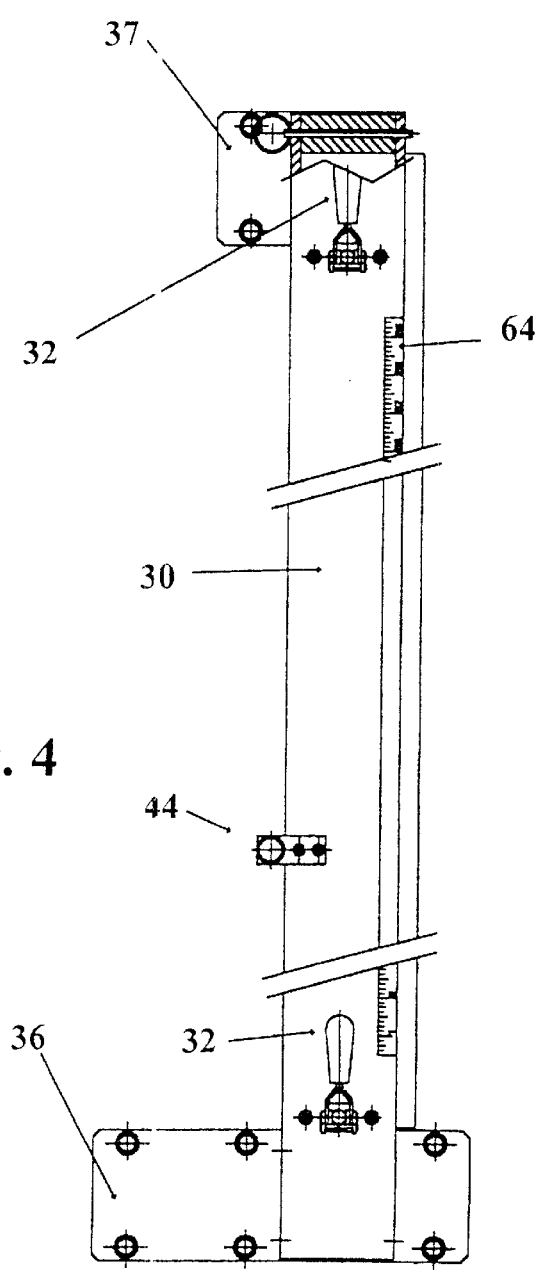
FIGS. 4–7 detail a traveling bridge assembly comprising part of the FIGS. 1–3 assembly.
Figure 5:
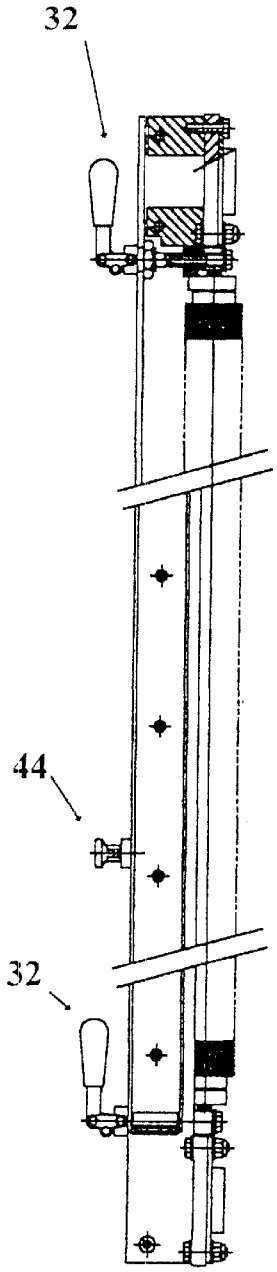
Figure 6:
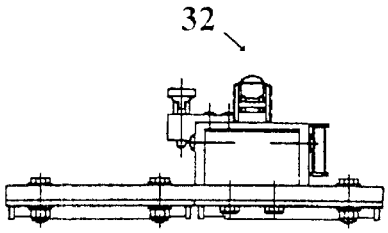
Figure 7:
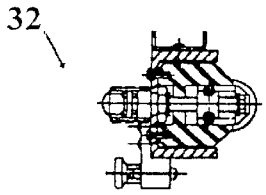
Figure 8:
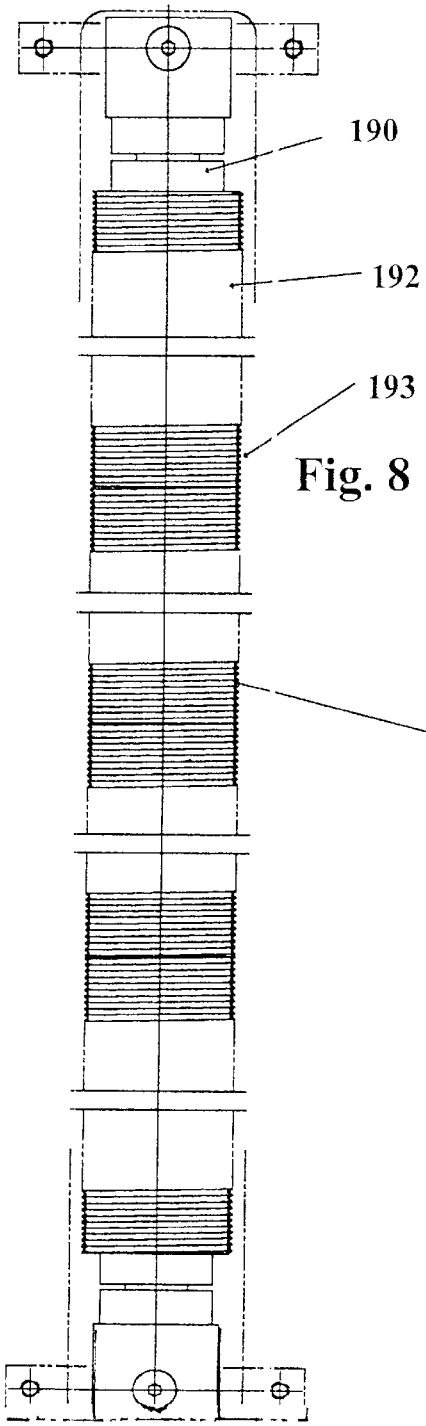
FIGS. 8–9 detail a roller assembly comprising part of the FIGS. 4–7 traveling bridge assembly.
Figure 9:
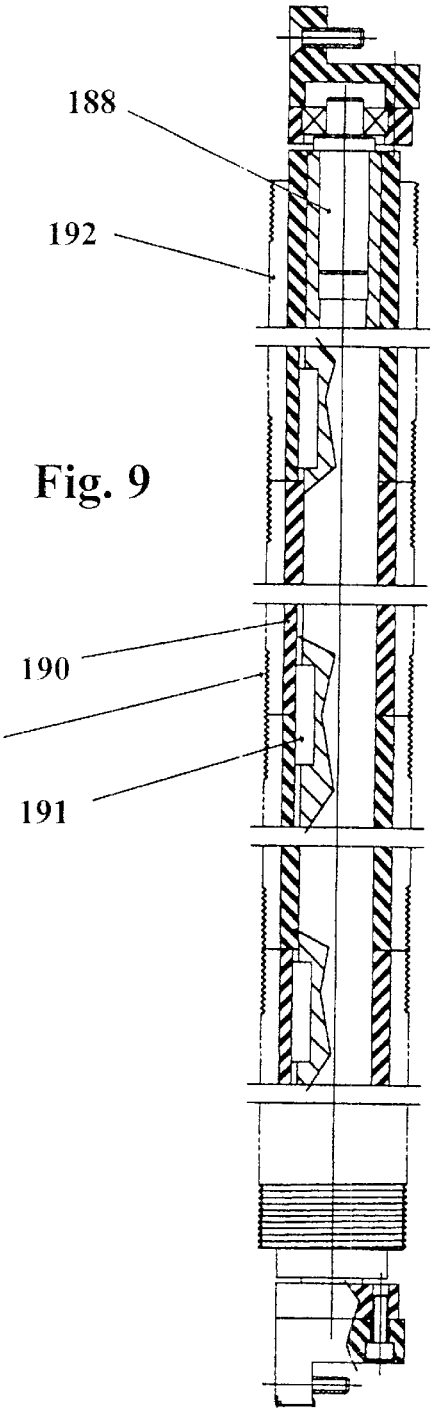

32. bridge idler roller See FIGS. 4–9. Supported within the cutter bridge 30 for selective manual movement between an operative descended position wherein it is in contact with table idler roller 86 and an inoperative elevated position. The bridge idler roller 32 is preferably comprised of a solid steel core 188 surrounded by a sleeve 190 of polyvinyl chloride which is coated with a layer 192 of NEOPRENE™ rubber. By way of example, the roller 188 may be approximately 1.5 inches thick. The NEOPRENE™ rubber layer 192 may be approximately 0.190 inch. As shown in FIG. 5, the PVC sleeve 190 is preferably formed as a number of shorter lengths of stock which are interlocked to each other and to the shaft using keys (one be shown at 191). The NEOPRENE™ rubber layer 192 has a series of circumferential grooves 193. In a preferred embodiment, the grooves are a 60 degree "V", one-sixteenth inch pitch, 0.040 inch deep thread ground into the layer 192.

34. clamps Preferably conventional "De-sta-co" Series 602 straight line toggle clamps which engage the ends of the roller 32 and are used to manually raise and lower the idler bridge roller 32.

36 and 37. bearing packs Conventional bearings for supporting the cutter bridge 30 for longitudinal reciprocal movement. May be model FBW 50110 700L, manufactured by THK Co., Ltd.

Figure 10A:
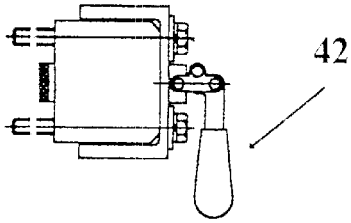
FIGS. 10, 10A and 11 detail a clamping assembly comprising part of the FIGS. 1–3 apparatus.
Figure 10:
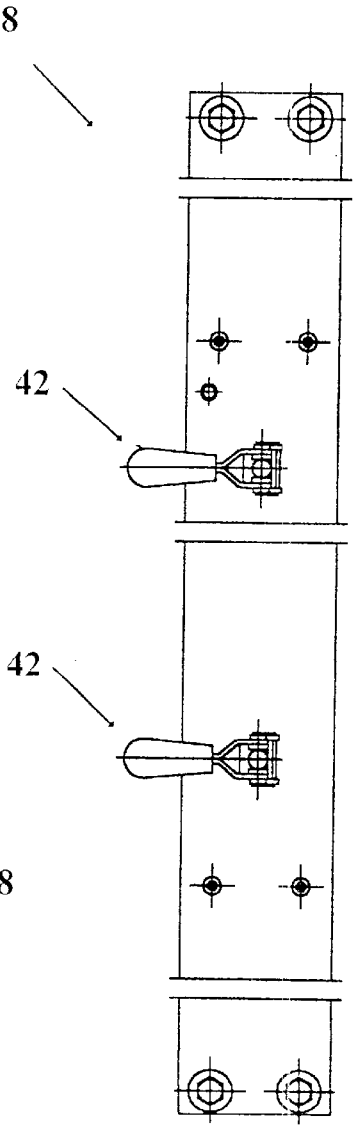
Figure 11:
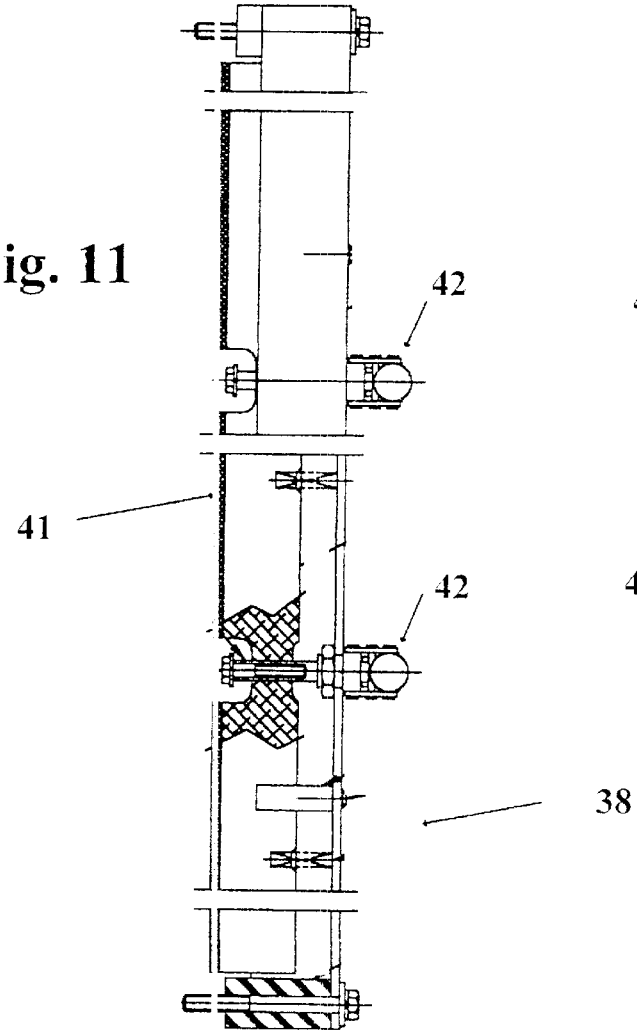
Figure 14:
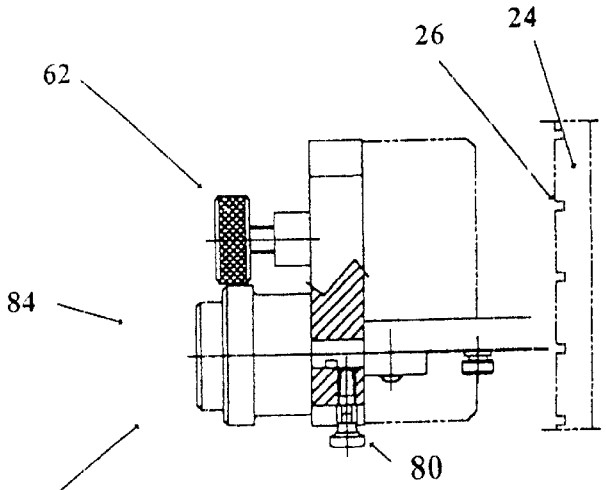
FIGS. 12–15 illustrate a cutter assembly carried by the traveling bridge assembly.

38. clampbar assembly Used to clamp the gel sheet material to the upper surface of the cutting table 24. Preferably has a stiff aluminum "U"-channel support member for supporting a retractable clamp bar 40 for vertical reciprocal motion. See FIGS. 10–11.

40. clamp bar Preferably a rigid tube of rectangular cross-section with a soft resilient pad 41 on the bottom for engaging the gel without marring or scratching it.

42. clamps Preferably conventional "De-sta-co" Series 602 straight line toggle clamps which are used to manually raise and lower the clamp bar 40.

44. lock A spring-loaded detent which engages a cavity in the clamp bar assembly 38 to lock the traveling cutter bridge 30 to the clamp bar assembly 38.

46. counter assembly Pivotally mounted to the cutting table 24 for measuring lengths of sheet stock as it is drawn across the table 24.

48. gel support rod Joined to the frame 22 at pivot 49, and retained at its free end by a cotter pin 51, the rod swings away from the table 24 to permit loading of a roll of gel (not shown) on the rod 48. After loading of the roll, the cotter pin 51 is returned to secure the rod.

50. lockable collars A pair of collars with lock nuts are slideably retained on the rod 48 and are employed to retain a gel roll on the rod 48 after the roll is properly positioned on the rod 48.

52. wheels For transporting the cutting table assembly 20.

54. handles Used to support and guide the table assembly 20 when being wheeled about.

56. collapsible table leg assemblies

58. cutter assembly Used to cut the gel.

60. cutter carriage A conventional bearing pack 61 supports the cutter carriage for sliding transverse reciprocal movement on the traveling cutter bridge. May be model FBW 50110 700L, manufactured by THK Co., Ltd.

62. thumb wheel lock For locking the cutter assembly 58 at a predetermined position along the traveling cutter bridge 30.

64. width ruler For setting the width of a strip or section of gel to be cut, or specifying the location of a longitudinal gel cut. FIG. 4.

66. length ruler For setting the length of material to be cut.

68. guide Positions and helps to guide the sheet material as it is being aligned or fed.

70. cutter blade Employed to sever the gel. May be a No. 19 Exacto™ blade or other similar cutting blade. It is easily replace by aligning it on pin 72, and tightening a thumb nut 74 against it.

76. cutter blade holder Cutter blade holder 76 is spring biased for reciprocatory vertical movement. Has a finger actuator button 78 which, when depressed, causes the blade 70 to move to a stop position where is slightly below the top surface 71 of the cutting table 24.

80. locking pin Is spring loaded to snap into an opening in the cutter blade holder 76 to retain the holder in its descended position with the blade 70 in its operative cutting position.

82. cutter assembly mount Supports the cutter blade holder 76 for vertical reciprocatory movement.

Figure 13:
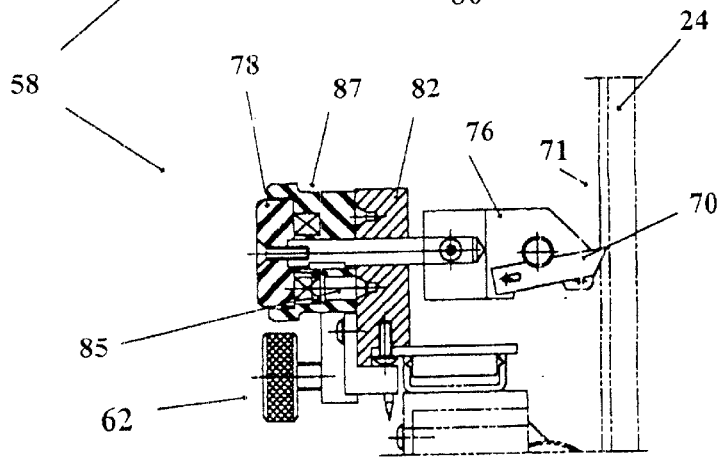
Figure 15:
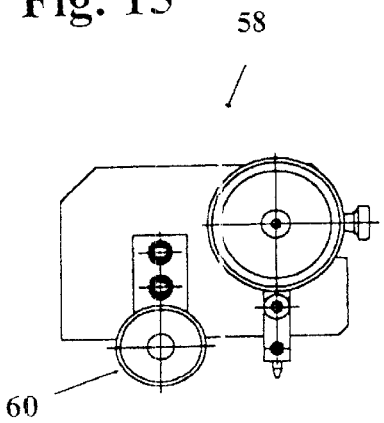
Figure 12:
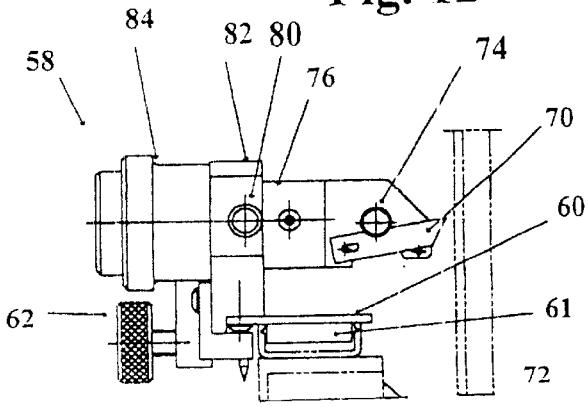
Figure 16:
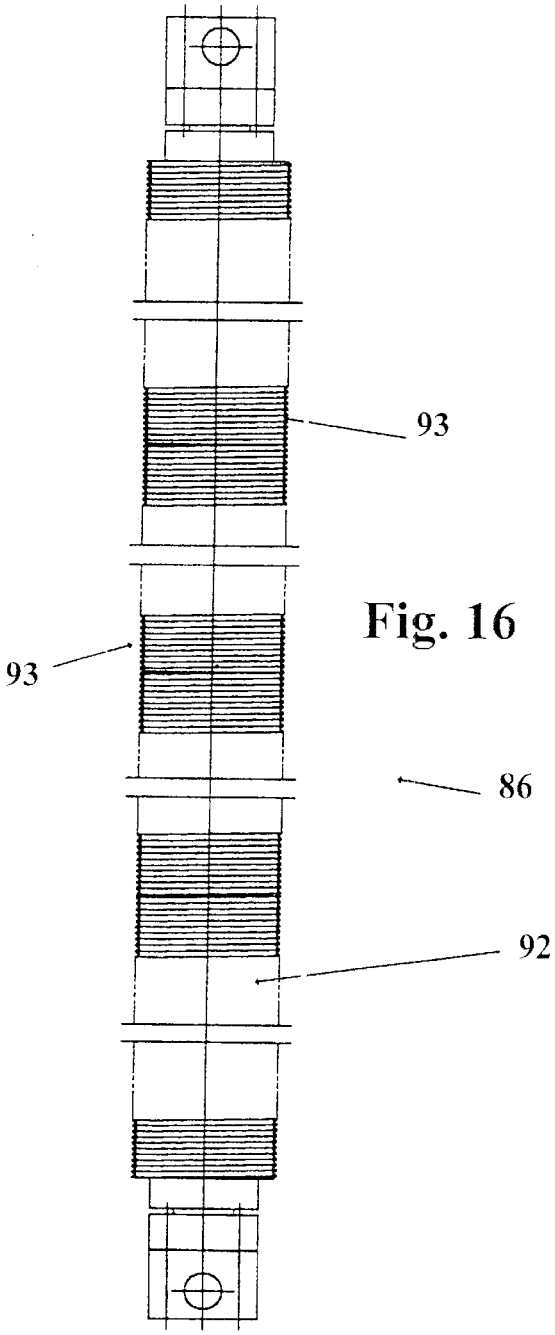
FIGS. 16–17 detail a table idler roller assembly similar to the FIGS. 8–9 roller assembly.
Figure 17:
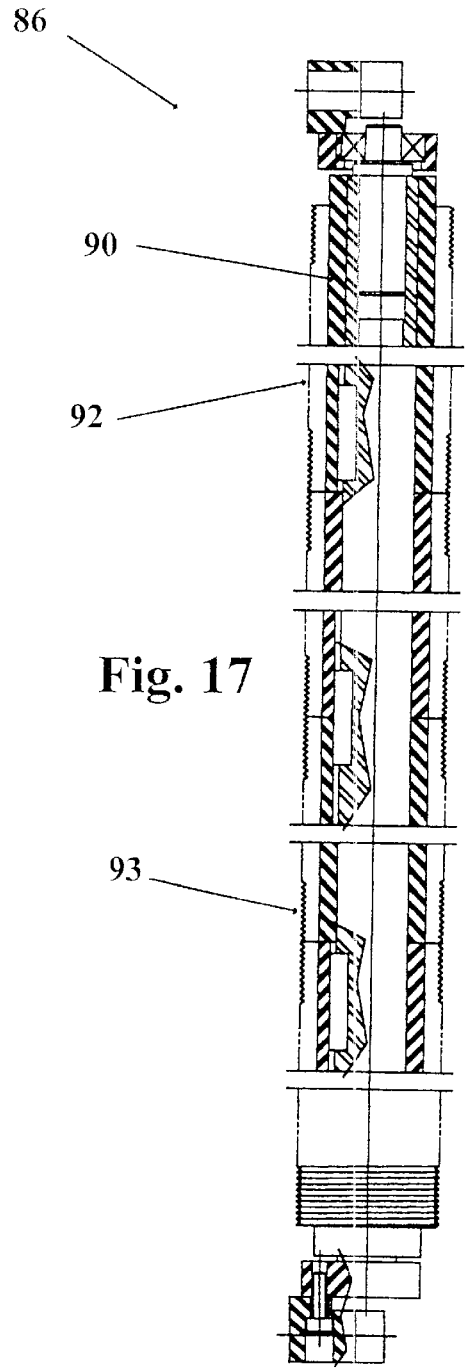

84. blade detent sleeve assembly Carries a spring-loaded detent 85 which is adapted to click-stop in one of four detent dimples in the top surface of mount 82 (two of which are shown in FIG. 13) corresponding to blade orientations of forward, back, left and right (0, 180, 90, and 270 degrees). Sleeve 87 is also spring loaded. To rotate and lock the blade in any of the four described positions, the sleeve 87 is raised and rotated to the desired blade orientation corresponding to alignment of the detent in one of the four 90-spaced dimples. The sleeve assembly 84 is released to lock the blade 70 in the selected position.

86. table idler roller An idler roller which mates with the bridge roller 32 carried by the traveling cutter bridge 30 when the cutter bridge is abutted against the clamp bar assembly 38 acting as a stop. The table roller 86 like the bridge roller 32 is preferably comprised of a solid steel core 88 surrounded by a sleeve 90 of polyvinyl chloride which is coated with a layer 92 of Neoprene™. By way of example, the roller may be approximately 1.5 inches thick. The Neoprene™ layer 92 may be approximately 0.190 inch. As with roller 32, the PVC sleeve 90 may be formed as a number of shorter lengths of stock which are keyed together and to the shaft to prevent relative rotation.

The Neoprene™ layer 92 has a series of circumferential grooves 93. In a preferred embodiment, the grooves are a 60 degree "V", one-sixteenth inch pitch, 0.040 inch deep thread ground into the layer 92. The construction of the rollers 32,86 has been found to be very important to cause the gel to come off its supply roller and travel smoothly across the table without slippage. Wandering of the gel has proven to be a challenge to overcome. I have found that the afore-described grooves on both rollers 32, 86 are very important to maintaining gel feed in a straight line.

Figure 1:
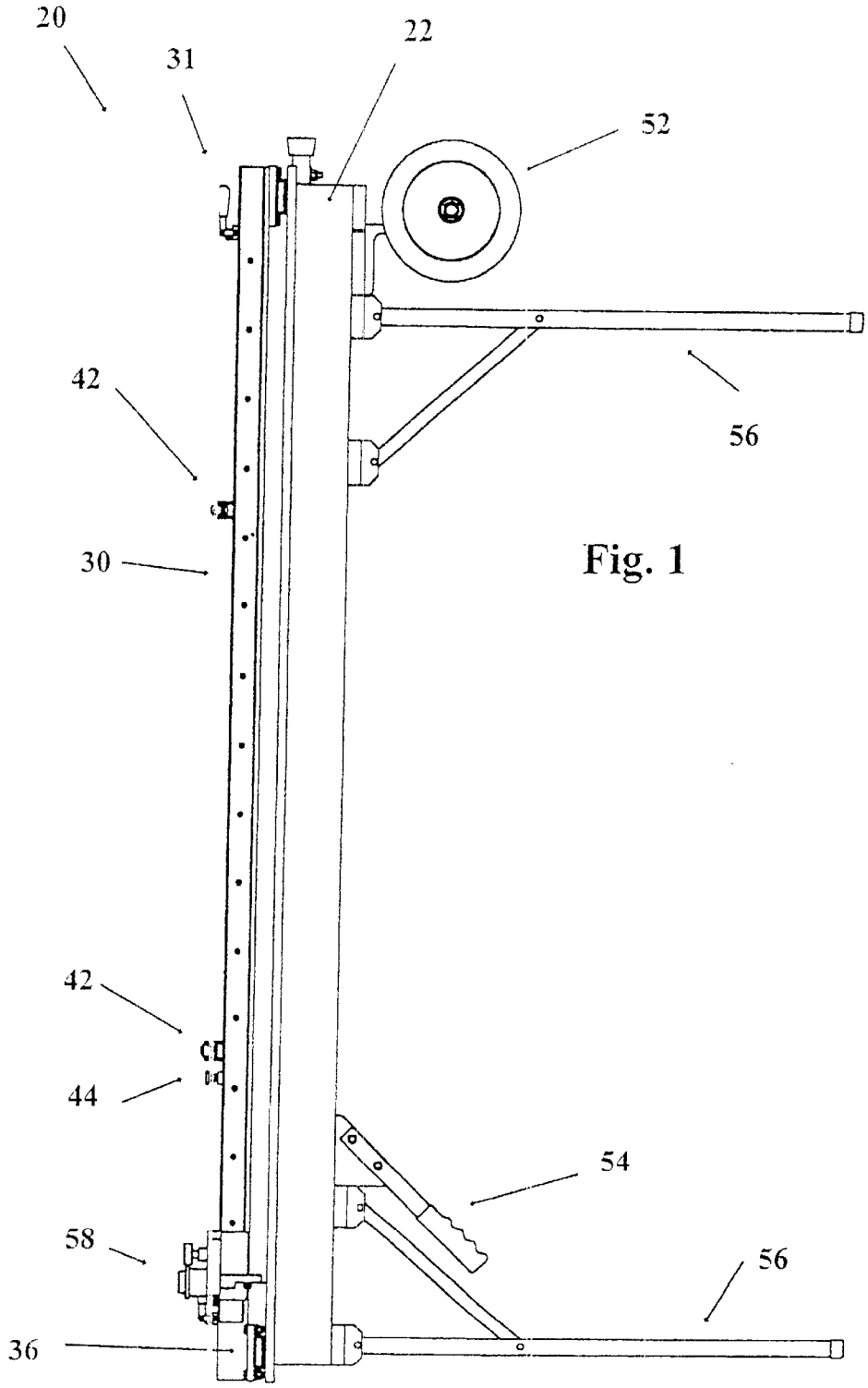
FIGS. 1–3 are side, top and end views of apparatus constructed in accordance with the teachings of the invention.
Figure 2:
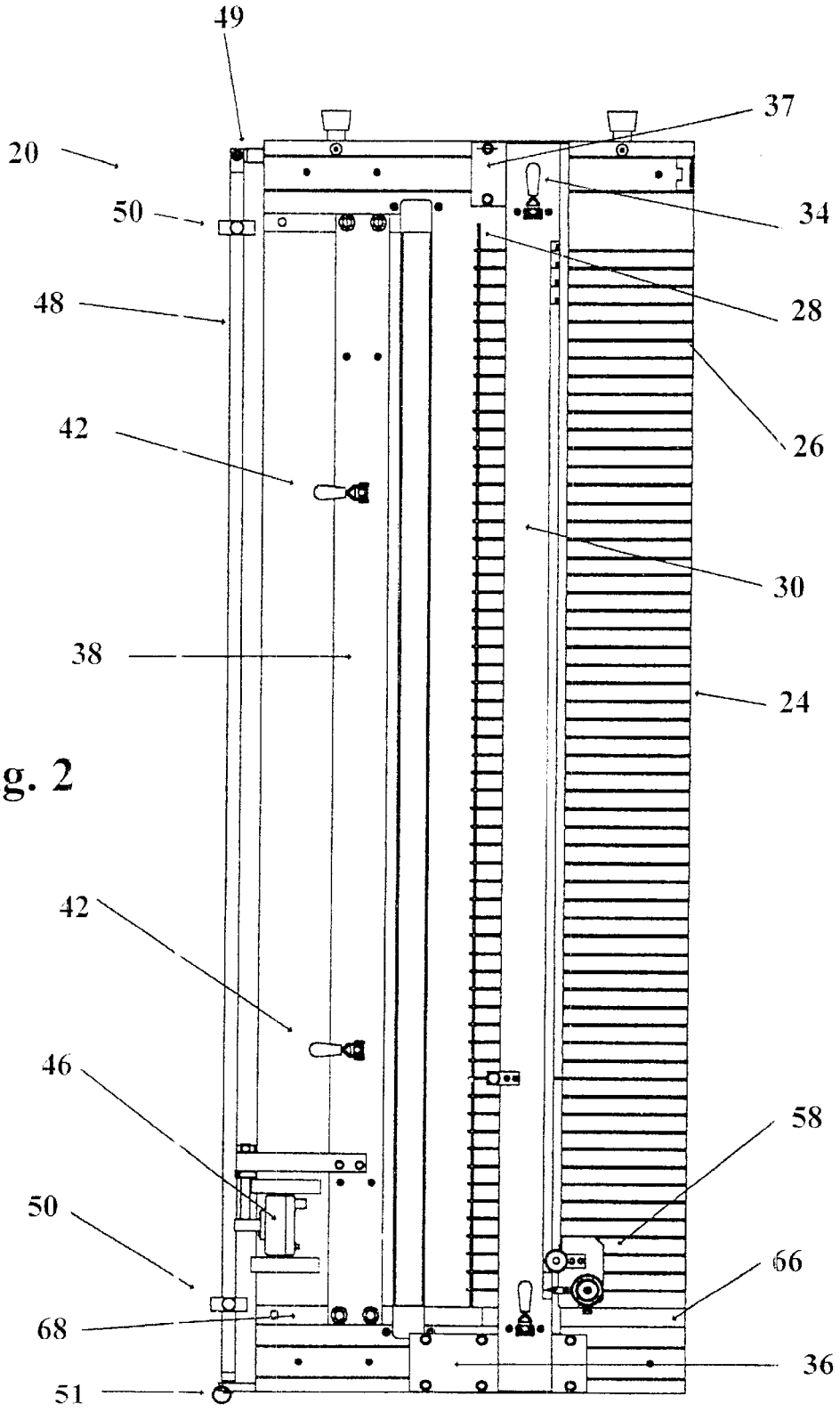
Figure 3:
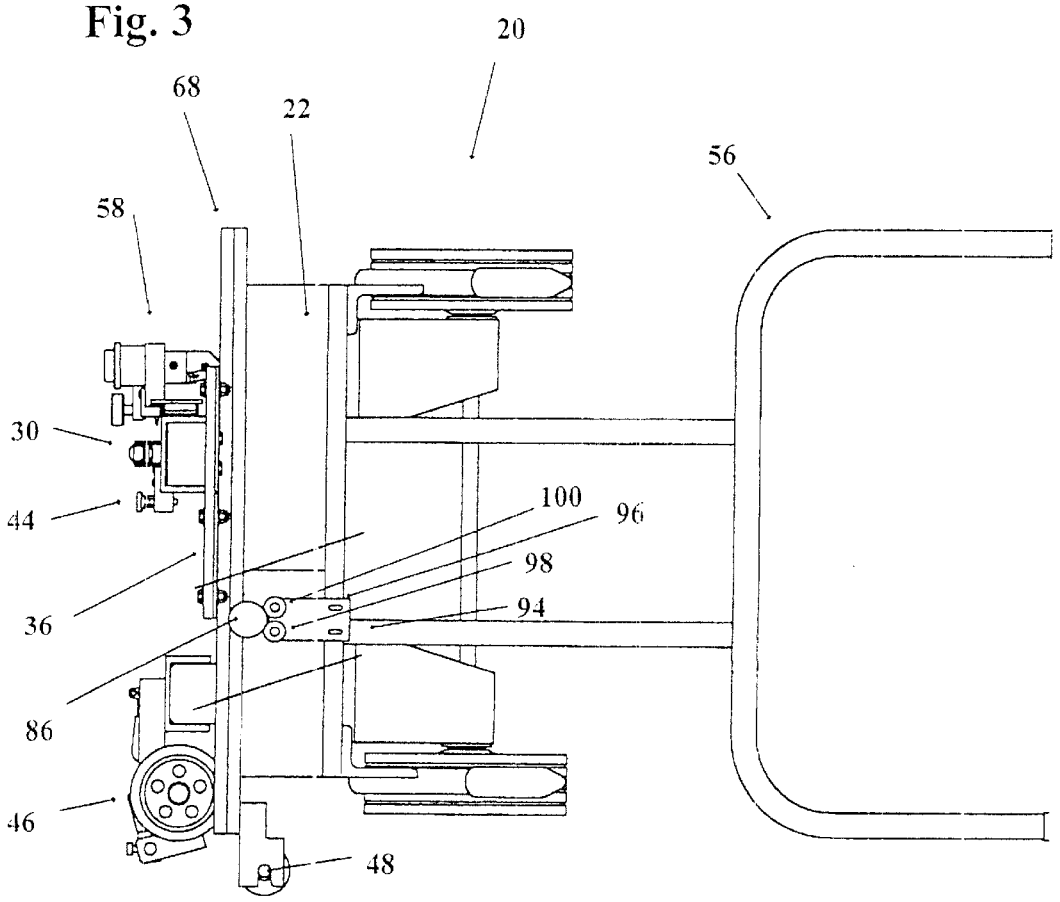
Figure 18:
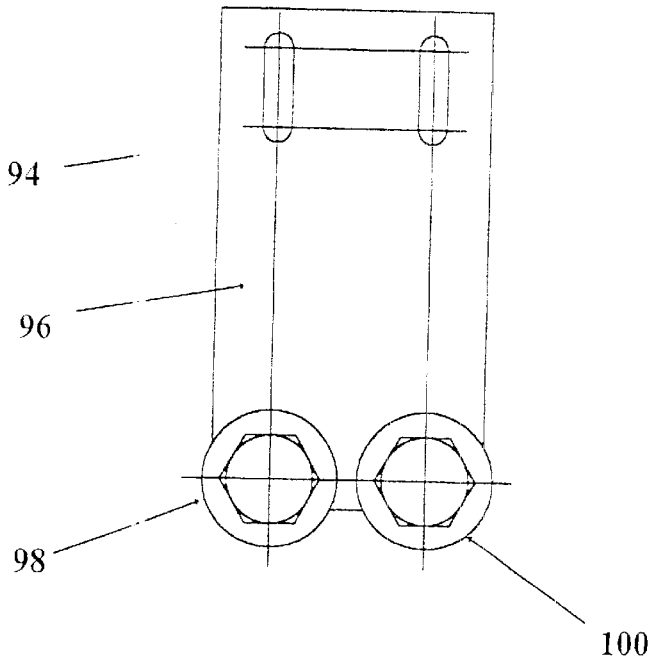
FIGS. 18–19 illustrate a roller support for the FIGS. 16–17 roller.
Figure 19:
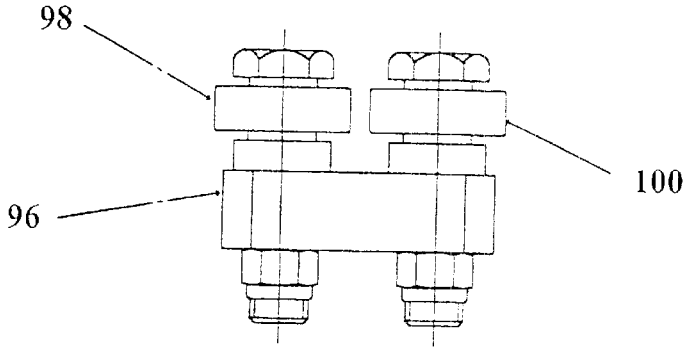

94. table idler roller supports See FIGS. 3, 18 and 19. The roller 86 is supported preferably at two spaced points along its length by vertically adjustable mounts 96 carrying a pair of spaced bearings 98, 100. The roller supports 94 have been found to be important to prevent sagging of the roller and consequent slipping or wandering of the sheet material as it is being pulled across the device cutter table assembly.

Operation

The cutting table assembly is versatile, having three main modes of operation.

Mode 1—Small Cuts

A gel roll (not shown) is slid onto rod 48 and the rod secured with cotter pin 51. The gel is then unwound and aligned with guide 68 which extends above the surface of the cutter table 24 a few inches. With the traveling cutter bridge 30 locked on the clamp bar assembly 38 and the table roller 86 aligned with bridge roller 32, but raised, the gel is threaded between the rollers 32 and 86, and manually pulled out to the desired length as measured against the length ruler 66. The clamp bar 40 is lowered using clamps 42 to secure the gel against the table 24.

To make five inch squares, for example, the user pulls the gel through the rollers 32, 86 to a mark of five inches on the length ruler 86, turns the blade 70 towards himself, and pushes down on the finger actuator button 78 on blade holder 76 to the stop position. The cutter bridge 30 is pulled toward the user. The blade 70 cuts the gel, riding in one of the longitudinal grooves 26, or between the grooves if not aligned with a groove. If a number of five-inch squares are desired, the user repeats the process every five inches along the width ruler 64 until the desired number of cuts has been made. The bridge 30 is then returned to one end of the transverse groove 28. The blade is rotated by lifting the sleeve assembly 84 and rotating the blade to the stop-click position corresponding to the correct blade orientation. The blade 70 is again pushed down to its limit position, and the cutter carriage 60 is moved along the cutter bridge 30 until all squares are severed and free. The result is a set of five-inch squares.

Mode 2—Large Cuts

Large cuts produce square or rectangular pieces of gel that cannot be made on the cutting table, such as one-foot by five-foot pieces. Large pieces such as this may be used to gel windows, for example.

To cut a one-foot by five-foot rectangular piece, for example, the user raises the clamp bar 40 and the bridge roller 32 and locks the bridge 30 against the clamp bar assembly 38, The cutter carriage 60 is positioned at 12 inches and locked there by tightening the thumb wheel lock 62. The blade 70 is rotated to a click-stop position on the width ruler 64 where it is facing away from the user, and locked down by releasing locking pin 80. Counter assembly 46 is pivoted down in contact with the gel and reset to zero.

With one hand on each side of the blade 70, the gel is grasped and pulled until the counter reads 5 feet. The blade 70 is unlocked, turned to the left, depressed, and moved to the left with the blade in transverse groove 28. The result will be a one-foot by five-foot strip of gel. To remove the waste, the blade is click-stopped to the right, depressed and moved to the extreme right, thereby severing a three-foot by five-foot piece of scrap gel.

Mode 3—Off-the-Roll Cuts

To make three more one-foot by five-foot strips from the scrap piece, the scrap piece is aligned with the edge guide 68, and the gel is threaded through the table roller 86 and bridge roller 32 (raising the bridge roller 32 if necessary). The cutter carriage 86 is set at 12 inches on the width ruler 64 and the blade rotated away from the user and locked down. The scrap gel piece is then pulled against the blade with one hand on each side of the blade, lifting the gel as it is pulled to assure that the blade stays in cutting engagement with the gel. When the scrap is pulled completely through, the result will be a second one-foot by five-foot strip. The process may be repeated to produce two more such strips.

Executions of the principles of the invention other than those described are within the scope of the present invention and are intended to be embraced by the following claims.

I claim:

1. Manually operable apparatus for cutting gel or other flexible sheet material, comprising a cutting table and a longitudinally reciprocable traveling bridge mounting a transversely translatable cutter carriage supporting a cutter assembly for manually selective movement to any position on the cutting table, said traveling bridge including an idler roller which is mounted to contact the table and which extends across the table commensurate with a range of movement of the cutter assembly, the idler roller being mounted parallel to and closely adjacent the cutter assembly such that a blade supported on the carriage is always close to a point of engagement of the roller with the table, whether the blade is being moved transversely to the table along the roller or whether the blade is stationed on the bridge and the bridge is being moved longitudinally along the table, whereby flexible sheet material being cut is always firmly held against the table by the idler roller close to a point where the knife engages the flexible sheet material to minimize wrinkling or tearing of the sheet material by the blade; said idler roller having means of being engaged to frictionally hold said gel materials while cutting.

2. The apparatus defined by claim 1 wherein said table mounts an idler roller.

3. The apparatus defined by claim 2 including a vertically adjustable roller support located between the ends of the table idler roller.

4. The apparatus defined by claim 3 including a vertically adjustable roller support located between the ends of the table idler roller.

* * * * *